US005889363A

United States Patent [19]

Beeteson et al.

[11] Patent Number: 5,889,363

[45] Date of Patent: Mar. 30, 1999

[54] DISPLAY DEVICES

[75] Inventors: John Beeteson, Ayrshire; Andrew Ramsay Knox, Kilbirnie; Christopher Carlo Pietrzak, Renfrewshire, all of United Kingdom

[73] Assignee: International Business Machines Corporation, Armonk, N.Y.

[21] Appl. No.: 841,137

[22] Filed: Apr. 29, 1997

[30] Foreign Application Priority Data

Oct. 4, 1996 [GB] United Kingdom ..... 9620843

[51] Int. Cl.[6] ..... H01J 29/00

[52] U.S. Cl. ..... 313/495; 313/496; 313/497; 313/422

[58] Field of Search ..... 313/495, 496, 313/497, 422

[56] References Cited

U.S. PATENT DOCUMENTS

| | | | |
|---|---|---|---|
| 3,622,829 | 11/1971 | Watanabe . | |
| 4,236,096 | 11/1980 | Tiemann . | |
| 4,618,801 | 10/1986 | Kakino | 313/495 |
| 4,900,981 | 2/1990 | Yamazaki et al. . | |
| 5,003,219 | 3/1991 | Muragishi et al. . | |
| 5,055,934 | 10/1991 | Swank . | |

FOREIGN PATENT DOCUMENTS

| | | |
|---|---|---|
| 18 688 | 11/1980 | European Pat. Off. . |
| 22 893 | 1/1981 | European Pat. Off. . |
| 450 134 | 10/1991 | European Pat. Off. . |
| 616 354 | 9/1994 | European Pat. Off. . |
| 0658915 | 6/1995 | European Pat. Off. . |
| 60-93742 | 5/1985 | Japan . |
| 62126519 | 6/1987 | Japan . |
| 22-99136 | 12/1990 | Japan . |
| 1144354 | 3/1965 | United Kingdom . |
| 1585645 | 3/1981 | United Kingdom . |
| 2276270 | 9/1994 | United Kingdom . |
| WO 94/20975 | 9/1994 | WIPO . |
| WO 96/08833 | 3/1996 | WIPO . |
| 96/18130 | 6/1996 | WIPO . |

OTHER PUBLICATIONS

Derwent Publications, Ltd. (1994) Excerpt from Database WPI, Section E1, Week 9411, vol. 5.

*Primary Examiner*—Nimeshkumar Patel
*Attorney, Agent, or Firm*—Scully, Scott, Murphy & Presser

[57] ABSTRACT

A display device having a screen is provided in which a back-plate is sealed to the screen to form an evacuated chamber. An area cathode is disposed between the back-plate and the screen. A permanent magnet is disposed between the cathode and the screen. A two dimensional array of rows and columns of channels extends between opposite poles of the magnet for receiving electrons from the cathode. An anode phosphor layer is disposed between the screen and the magnet for receiving electrons from the channels. A grid electrode between the area cathode and the magnet controls flow of electrons from the cathode into the channels, whereas an anode between the magnet and the anode phosphor layer controls flow of electrons from the channels towards the screen. In a preferred embodiment, the cathode means comprises the backplate and a silica glass substrate peripherally sealed to the back-plate to produce a chamber in which a gas is contained. A layer of photo-sensitive material is disposed on the surface of the substrate external to the chamber. A cathode phosphor layer is disposed between the back-plate and the substrate. A pair of electrodes facing each other from opposite sides of the chamber energizes the gas to generate a plasma for exciting the phosphor to generate light energy to produce electron emissions from the photo-cathode.

9 Claims, 6 Drawing Sheets

DISPLAY DEVICES

DESCRIPTION

1. Technical Field

The present invention relates in general to improvements in or relating to display devices, and relates in particular to improvements in screens for flat panel vacuum electron display devices, to improvements in spacers for flat panel electron vacuum electron devices, and to improvements in cathodes for flat panel vacuum electron devices.

2. Background of the Invention

A magnetic matrix display device is particularly although not exclusively useful in flat panel display applications. Such applications include television receivers and visual display units for computers, especially portable computers, personal organisers, communications equipment, and the like.

SUMMARY OF THE INVENTION

In accordance with the present invention, there is now provided a display device comprising: a screen comprising a layer of a transparent plastic material; a back plate sealed to the screen to form an evacuated chamber; area cathode means disposed between the back plate and the screen; a permanent magnet disposed between the cathode and the screen; a two dimensional array of rows and columns of channels extending between opposite poles of the magnet for receiving electrons from the cathode; an anode phosphor layer disposed between screen means and the magnet for controlling flow of electrons from the cathode means into the channels; and anode means disposed between the magnet and the anode phosphor layer for controlling flow of electrons from the channels towards the screen.

Preferably, the screen comprises a barrier layer disposed between plastic layer and the anode phosphor layer for preventing outgassing from the plastic layer into the evacuated chamber.

In preferred embodiments of the present invention to be described shortly, the barrier layer comprises a glass layer.

The barrier layer may alternatively however comprise a hardened polymer coating.

The screen preferably comprises a pre-curved portion brought into a compressed state by pressure difference between the evacuated chamber and atmospheric pressure.

Viewing the present invention from another aspect, there is provided a spacer for spacing two parallel surfaces in a flat panel display, the spacer comprising an elongate body having a larger cross sectional area at one end of the spacer tapering to a smaller cross sectional area at the other end of the spacer.

The body may have a circular cross-section. Alternatively, the body may have a cross-section in the form of a four-pointed star. Whatever the shape of the cross-section of the body however, the cross sectional area of the body may reduce in proportion to distance from one end of the spacer. In particularly preferred embodiments of the present invention, the spacer comprises a ceramic.

The present invention extends to a display device comprising a screen; a back plate sealed to the screen to form an evacuated chamber; area cathode means disposed between the back plate and the screen; a permanent magnet disposed between the cathode and the screen; a two dimensional array of rows and columns of channels extending between opposite poles of the magnet for receiving electrons from the cathode; an anode phosphor layer disposed between screen and the magnet for receiving electrons from the channels; grid electrode means disposed between the area cathode means and the magnet for controlling flow of electrons from the cathode means into the channels; anode means disposed between the magnet and the anode phosphor layer for controlling flow of electrons from the channels towards the screen; and a plurality of spacers as hereinbefore described disposed between the screen and the magnet for spacing the screen from the magnet.

Viewing the present invention from yet another aspect, there is provided a display device comprising: a screen; a back plate sealed to the screen to form an evacuated chamber; area cathode means disposed between the back plate and the screen; a permanent magnet disposed between the cathode and the screen; a two dimensional array of rows and columns of channels extending between opposite poles of the magnet for receiving electrons from the cathode; an anode phosphor layer disposed between screen and the magnet for receiving electrons from the channels; grid electrode means disposed between the area cathode means and the magnet for controlling flow of electrons from the cathode means into the channels; anode means disposed between the magnet and the anode phosphor layer for controlling flow of electrons from the channels towards the screen; and a plurality of spacers for spacing the magnet from the cathode, the spacers being disposed within recesses formed in the grid electrode means.

Viewing the present invention from a further aspect, there is provided area cathode apparatus for generating free electrons in an evacuated chamber, the apparatus comprising: a back-plate; a silica glass substrate peripherally sealed to the back-plate to produce a chamber; a gas contained in the chamber; a layer of photo-sensitive material disposed on the surface of the substrate external to the chamber; a cathode phosphor layer disposed between the back plate and the substrate; and a pair of electrodes facing each other from opposite sides of the chamber for energising the gas to generate a plasma for exciting the cathode phosphor layer to generate light energy for producing electron emissions from the layer of photo-sensitive material.

The present invention extends to a display device comprising: a screen; area cathode apparatus as described in the preceding paragraph sealed to the screen to form an evacuated chamber; a permanent magnet disposed between the cathode and the screen; a two dimensional array of rows and columns of channels extending between opposite poles of the magnet for receiving electrons from the cathode; an anode phosphor layer disposed between screen and the magnet for receiving electrons from the channels; grid electrode means disposed between the area cathode means and the magnet for controlling flow of electrons from the cathode means into the channels; anode means disposed between the magnet and the anode phosphor layer for controlling flow of electrons from the channels towards the screen.

The area cathode apparatus preferably comprises an array of convex lenses disposed between the cathode phosphor layer and substrate, each lens corresponding to different channel and each lens focusing light energy from the cathode phosphor layer onto a different region of the cathode.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENTS

Figure 1:
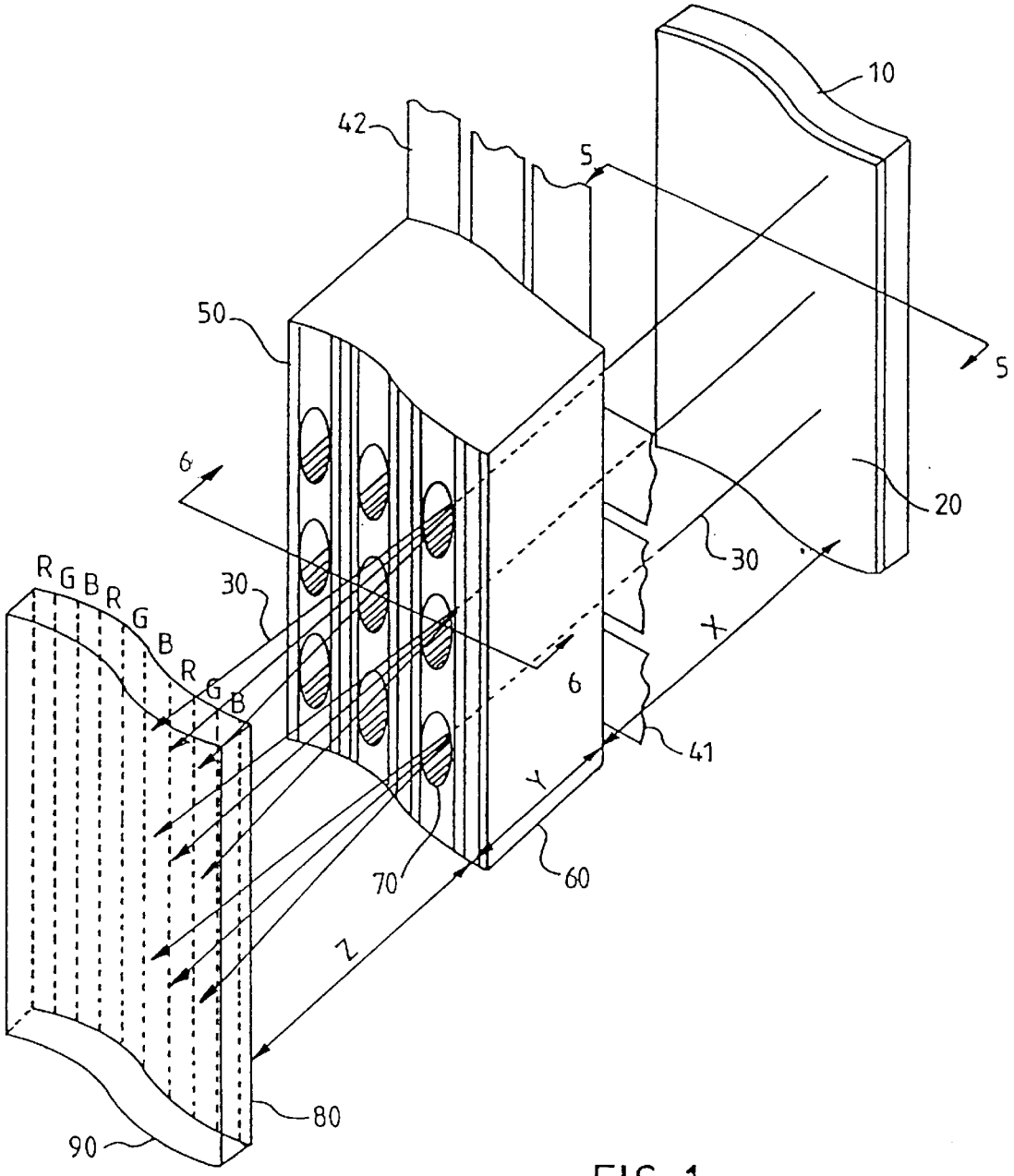
FIG. 1 is an exploded diagram of an example of a colour Magnetic Matrix Display.

Referring first to FIG. 1, an example of a colour magnetic matrix display comprises a back-plate 10 carrying a cathode 20 and a screen plate 90 carrying a coating of sequentially arranged red, green and blue phosphor stripes 80 facing the cathode 20. Adjacent phosphor stripes 80 are separated by a black matrix. The phosphors are preferably high voltage phosphors. A final anode layer (not shown) is disposed on the phosphor coating 80. A permanent magnet 60 is disposed between plates 90 and 10. The magnet is perforated by a two dimension matrix of perforation or "pixel wells" 70. An array of anodes 50 are formed on the surface of the magnet 60 facing the phosphors 80. For the purposes of explanation of the operation of the display, this surface will be referred to as the top of the magnet 60. There is a pair of anodes 50 associated with each column of the matrix of pixel wells 70. The anode of each pair extend along opposite sides of the corresponding column of pixel wells 70. A control grid is formed on the surface of the magnet 60 facing the cathode 20. For the purposes of explanation of the operation of the display, this surface will be referred to as the bottom of the magnet 60. The control grid comprises a first group of parallel control grid conductors 41 extending across the magnet surface in a row direction and a second group of parallel control grid conductors 42 extending across the magnet surface in a column direction so that each pixel well 70 is situated at the intersection of different combination of a row grid conductor 41 and a column grid conductor 42. Plates 10 and 90, and magnet 60 are brought together, sealed and then the whole is evacuated. In operation, electrons are released from the cathode and attracted towards the control grid. The control grid provides a row/column matrix addressing mechanism for selectively admitting electrons to each pixel well 70. Electrons pass through the control grid into an addressed pixel well 70. In each pixel well 70, there is an intense magnetic field. The magnetic field in each well 70 collimates electrons therein into a dense beam. The pair of anodes 50 at the top of pixel well 70 accelerate the electrons through pixel well 70 and provide selective sideways deflection of the emerging electron beam 30. Electron beam 30 is then accelerated towards a higher voltage anode formed on anode phosphor layer 80 to produce a high velocity electron beam 30 having sufficient energy to penetrate the anode and reach the underlying phosphors 80 resulting in light output. A time-varying differential voltage is applied across deflection anodes 50 to sequentially index electron beam 30 to the corresponding red, green and blue phosphor stripes. The current carried by electron beam 30 is simultaneously varied sequentially in accordance with red, green and blue video signals for generating an image on the screen 90. The distance X between cathode 20 and magnet 60 is typically 0.1 mm; the thickness Y of magnet 60 is typically 1 mm; and, the distance Z between magnet 60 and phosphors 80 is typically 5 mm. Spacers (not shown) are disposed between the control grid 40 and cathode 20 to maintain the distance between magnet 60 and cathode 20. The spacers are preferably in the form of glass spheres.

It will be appreciated that, because the space within the magnetic matrix display device hereinbefore described is evacuated, forces are imposed on plates 10 and 90 by atmospheric pressure. In the interest of cost-effectiveness, plates 10 and 90 may be formed from glass of sufficient thickness to withstand such forces. However, a problem with this arrangement is that glass is a relatively heavy material. Therefore, while magnetic matrix display panels having glass plates 10 and 90 may be acceptable for desk-top display application, such panels are undesirable for application where light weight would be an advantage such as application in the field of avionics, automobile, or portable computing. This problem is solved in a preferred embodiment of the present invention in which display weight is reduced by forming one or both of plates 10 and 90 at least partially from a relatively light-weight plastics material such as optically clear Acrylic plastic.

Plastics materials such as optically clear Acrylic plastic have long been available. However use of such plastics materials in vacuum electron devices such as cathode ray display tubes (CRTs) has not been contemplated for two reasons. Firstly, residual volatile organic compounds present in plastics generally tend to out-gas into a vacuum causing detrimental effects to cathodes. Secondly, for reason of safety, conventional CRTs need to be sufficiently strong to withstand the projectile effect of the electron gun impacting the screen under implosion conditions. In conventional CRTS, such strength is produced by forming the screen from thick glass under extreme compression from a steel tension band. Glass becomes stronger when subjected to compression). One advantage of MMD technology over conventional CRT technology is that, in an MMD, there is no electron gun to potentially be projected towards the screen during implosion conditions. Another advantage of MMD technology over conventional CRT technology is that the volume of enclosed vacuum in an MMD is very small in comparison to that in a conventional CRT, so that the implosion energy associated with an MMD is very small in comparison with that associated with a conventional CRT. It will be appreciated therefore that the resistance of an MMD screen 90 to implosion forces can be much lower than the resistance to implosion forces required for the screen of a conventional CRT. It will then be appreciated that MMDs can be based on lighter weight materials than those employed in the construction of conventional CRTS.

In general, plastic materials have a lower stiffness than glasses. Therefore, a plastic screen sags more than a glass screen under atmospheric pressure. For a flat rectangular plate of aspect ratio 4:3 supported on all four sides and subject to a uniform load, the sag at the centre is approximately given by:

$$Y(\text{mm}) = \frac{25.4 \times 0.07 \times P \times r^4}{E \times t^3}$$

Where P=load, r=shorter side length, t=thickness, E=Youngs Modulus.

Figure 2:
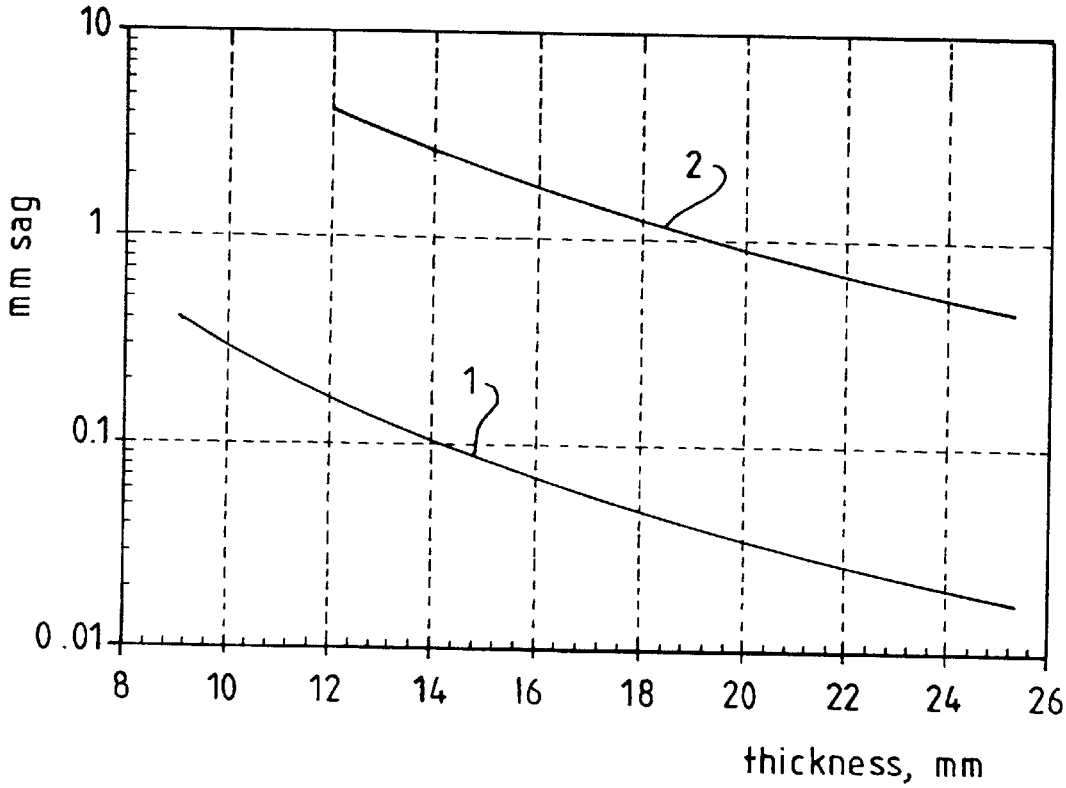
FIG. 2 is a graph of sag against thickness for sheet glass (line 1) and acrylic (line 2)

For a 40 cm display under atmospheric pressure:

P=14.7 lb/sq in r=9.25 in $E=10.9\times10^6$ lb/sq in for glass $E=0.44\times10^6$ lb/sq in for acrylic plastic Referring now to FIG. 2, for a flat face CRT, a glass thickness of 13 mm is typical, giving a sag, as shown by line 1, of 0.13 mm. To achieve the same result with acrylic plastic requires a thickness, as shown by line 2, of over 40 mm. This thickness is undesirable from an optical viewpoint because of the associated optical distortion.

In a particularly preferred embodiment of the present invention, this problem is solved by providing the acrylic screen with a pre-curvature in the opposite direction to that occurring naturally under atmospheric pressure. In use then, atmospheric pressure acts to flatten the screen. The pre-curvature permits use of an acrylic screen of thickness of 13 mm or less.

Figure 3:
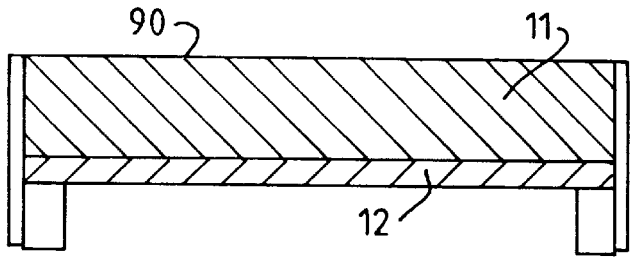
FIG. 3 is a cross-sectional view through a glass-acrylic laminated screen.
Figure 4:
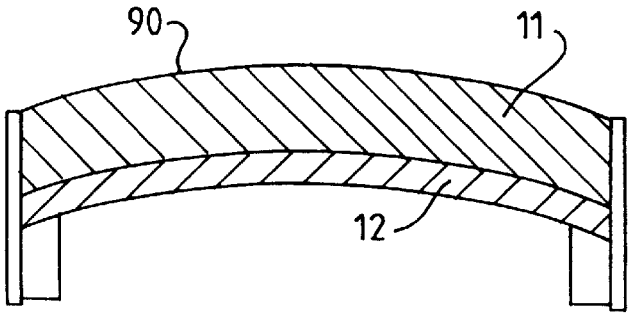
FIG. 4 is a cross-sectional view through another glass-acrylic laminated screen.

Referring now to FIG. 3, in another particularly preferred embodiment of the present invention, the sag problem is solved by forming the screen from a laminate comprising relatively thin (typically 1 mm) glass layer 12 and a thicker acrylic plastic layer 11 bonded together with an adhesive such as 3M pressure sensitive solid flexible acrylic 4910F. In a modification to this particularly preferred embodiment of the present invention, the laminate is pre-distorted with the glass layer 12 on the concave inner surface. Thus, with reference now to FIG. 4, in use the glass layer 12 is forced by atmospheric pressure into compression. As mentioned earlier, glass is strongest when compressed.

In some preferred embodiments of the present invention, the weight of the display is reduced by forming the back plate 10 and sides of the display from acrylic as well as the screen plate 90. Equally, in some other preferred embodiments of the present invention, the back plate 10 and sides of the display are formed from an acrylic-glass laminate in addition to the screen plate 90. The glass is preferably laminated onto those surfaces of the acrylic facing the interior of the display. The glass thus advantageously forms a barrier between the evacuated environment and the plastic thereby preventing out-gassing of organic compounds from the plastic into the display. Experiments indicate that replacement of glass with acrylic reduces the total weight of the display by more than half.

In especially preferred embodiments of the present invention in which at least the screen 90 is formed from acrylic, the problem of out-gassing is solved by coating the interior surface of the acrylic with a hard coat material such as Peeraguard. Such materials are typically UV activated coatings with a high degree of cross linking in the constituent polymer chains, thereby forming a barrier against out-gassing. A coating of such a material also advantageously seals any micro-cracks sometimes formed in the surface of acrylic plastic.

In the embodiments of the present invention hereinbefore described, a at least the screen 90 of the display is formed from acrylic or acrylic-glass laminate in the interests of reducing weight. However, such measures may not reduce the weight sufficiently for some portable applications.

Figure 5:
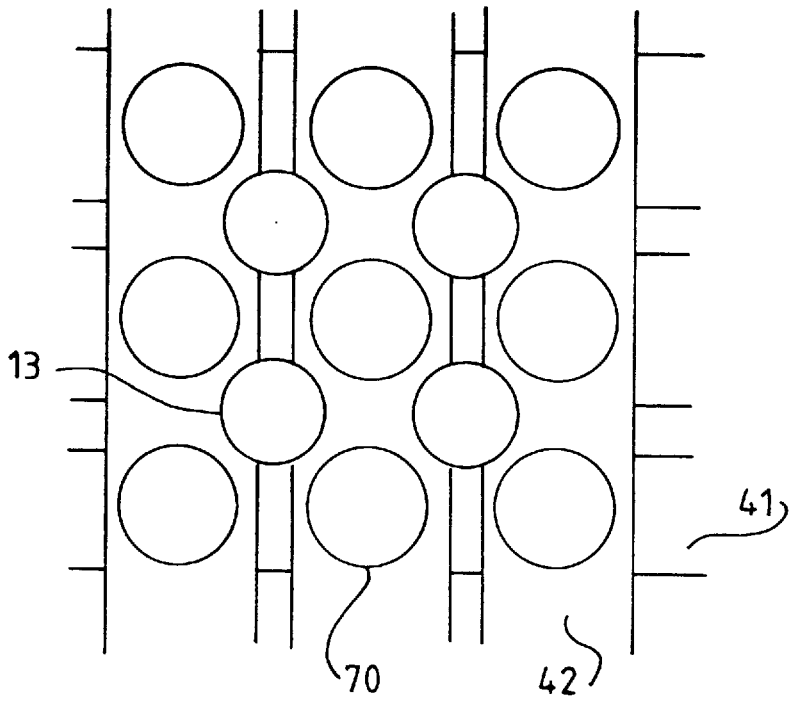
FIG. 5 is a cross-sectional plan view of an example of a magnetic matrix display when viewed in the plane 5–5' in FIG. 1 in the direction of the arrows.

Referring now to FIG. 5, as mentioned earlier, glass spheres 13 may be employed to space cathode 20 and back-plate 10 from magnet 60. In preferred embodiments of the present invention, the aforementioned weight problem is solved by employing additional spacers to space screen 90 from magnet 60. The additional spacers render the display self-supporting against atmospheric pressure and hence permit screen plate 90 to be formed from thinner glass, thereby reducing both weight and thickness of the display. In particularly preferred embodiments of the present invention, a bonded plastic coating, preferably an anti-reflection coating, is applied to the outside of screen 90 to prevent any glass splintering in the event of breakage.

It will be appreciated that, in the interests of preventing unwanted visual effects, the additional spacers described in the previous paragraph preferably fit within the limited space available in the black matrix between adjacent phosphor stripes 80. In a typical high resolution screen with a pixel spacing of 0.3 mm, each phosphor stripe 80 is typically of the order of 0.07 mm wide and each black matrix stripe is typically of the order of 0.03 mm wide. The part of the spacer abutting the stripe is therefore preferably no wider than 0.03 mm. In conventional flat panel vacuum electron display technologies such as field emission display (FED) technology, there is one electron beam per sub-pixel (Red, Green or Blue). Therefore the base of each spacer must have substantially the same dimensions as the surface abutting the screen, eg: 0.03 mm in the present example. High voltage phosphors of the kind employed in a typical MMD device operate at 6 kV minimum. This leads to a preferred spacer height of 1 mm minimum. To satisfy these criteria with a rectangular spacer requires an aspect ration of 1/0.03 or 33:1. Spacers with such an aspect ratio have proved difficult to manufacture. This has proved to be a significant problem in the development of FED technologies.

MMD technology has the advantage of requiring only one electron beam per pixel, because in MMD technology, as mentioned earlier, beam indexing is employed to sequentially address each colour sub-pixel of a pixel. This leads to a much larger surface area available on the side of magnet 60 facing screen 90 for siting spacers. In particularly preferred embodiments of the present invention, the spacers between magnet 60 and screen plate 90 are tapered in form, having a relatively large area base rising to a tip (typically of 0.03 mm diameter) for abutting the black matrix on screen plate 90. The spacers are preferably conical. Alternatively the spacer may be star-shaped in cross-section although still defining a conical volume. It will be appreciated that such spacers define a larger volume and have a smaller aspect ratio than conventional rectangular spacers.

Figure 6:
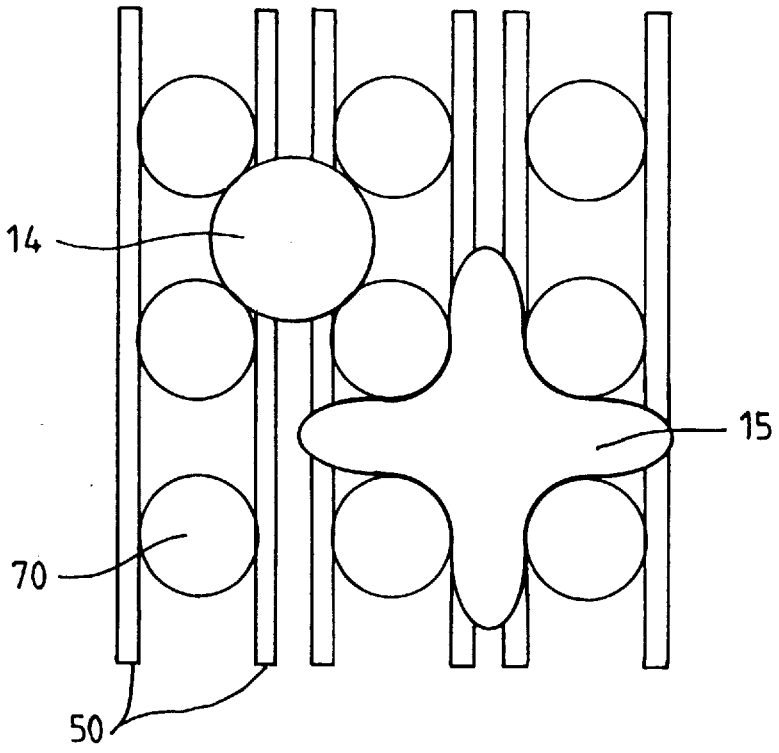
FIG. 6 is a cross-sectional plan view of an example of a magnetic matrix display when viewed in the plane 6–6' in FIG. 1 in the direction of the arrows.

FIG. 6 shows the area of magnet 60 available for occupation by the base of a conical spacer 14, together with the area of magnet 60 available for occupation by the base of a star-shaped spacer 15, without obscuring adjacent pixel wells 70. It will be appreciated that, for a pixel well spacing of 0.3 mm and a pixel well diameter of 0.18 mm, the maximum diameter of the base of the conical spacer 14 is 0.244 mm. The base of the star shaped spacer 15 can extend further, spanning 0.172 mm in orthogonal directions because the star-shaped spacer 15 can be arranged to fit between adjacent pixels.

Figure 7:
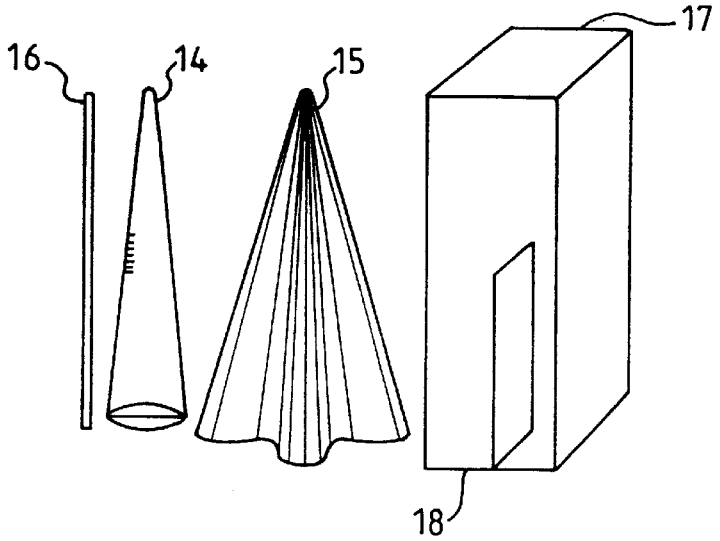
FIG. 7 is an isometric view of spacers for a magnetic matrix display.

FIG. 7 shows, in proportion, an example of a conical spacer 14; an example of a star shaped tapered spacer 15; and, an equivalent rectangular spacer 16 as found in typical field emission displays for comparison. A conventional type 402 surface mount (SMT) package 17 and a conventional type 201 SMT package 18 are also shown in proportion for comparison. The tapered spacers 14 and 15 are easier to manufacture; easier to handle and align (because of their distinctive shape); and stronger than the conventional rectangular equivalents 16. It will be appreciated by comparing the tapered spacers 14 and 15 with the conventional SMT components 17 and 18 along-side that conventional surface mount component pick and place techniques can be employed for bonding, via an epoxy adhesive for example, the tapered spacers 14 and 15 during assembly of the display. It will also be appreciated, given the difference in dimensions between the rectangular equivalent spacer 16 and the SMT components 17 and 18, that mounting the equivalent rectangular spacers 16 by SMT techniques present an extreme challenge in comparison with mounting the tapered spacers 14 and 15. The MMD allows such a large base area that, by tapering the spacers, much larger spacer height can be practically employed.

In a particularly preferred embodiment of the present invention, the tapered spacers 14 and 15 are manufactured from ceramics via a moulding and sintering process. The base material for moulding may be in slurry or dry powder form with binders and lubricators added. The sintering step can be completed with the spacers still in the mould or with the cast spacers removed from the mould. Removal from the mould is greatly simplified by the tapered form of the spacers 14 and 15. The uniform cross-section of the conventional rectangular spacer 16 is much more difficult to mould.

As mentioned earlier with reference to FIG. 5, in an example of a MMD display, magnet 60 is spaced from cathode 20 by spacers 13. It is desirable in electron beam display devices to maintain precise spacing between the cathode and the control grid structure. In displays employing area cathodes, such as MMD displays, where a large number of individual electron beams are formed from a single cathode, it is even more desirable to maintain a precise cathode-grid spacing because deviations in spacings may produce variations in operating characteristics between different pixels and hence performance degradation.

In particularly preferred embodiments of the present invention, cathode 20 forms at least part of a barrier between the vacuum, inside the display and the air outside to the display. In some embodiments of the present invention, such as those comprising a back-lit photo-cathode, there may be an additional intermediate layer contributing to the barrier. As mentioned earlier, air pressure exerts a significant force on an evacuated chamber. For example, a typical 40 cm display experiences pressure equivalent to a weight of nearly a ton on the screen plate 90 and back plate 10 of the chamber. As also mentioned earlier, unless compensated, such a force may cause deflection of plates 10 and 90 leading to performance degradation.

As mentioned earlier, a typical MMD display comprises a plane area cathode 20. Such cathodes include, without limitation, photo-cathodes, Metal-Insulator-Metal (MIM) cathodes, and carbon nano-tube cathodes. All such cathodes can be formed as a relatively thin sheet. Additional strength is preferably imparted to such a cathode to support atmospheric pressure unless measures are taken to support the cathode at points distributed across it's surface area. In a typical MMD display, magnetic fields from magnet 60 extend below each pixel well 70 towards the cathode 20. Electron collection from the cathode 20 therefore tends to be concentrated in an area approximately the same size as the facing pixel well aperture. A significant portion of the surface of cathode 20 therefore makes little or no contribution to the production of electrons from which the electron beams are formed to produce the displayed image. Similarly, there is a corresponding area of magnet 60 between the pixel wells 70 available for placement of spacers.

Figure 8:
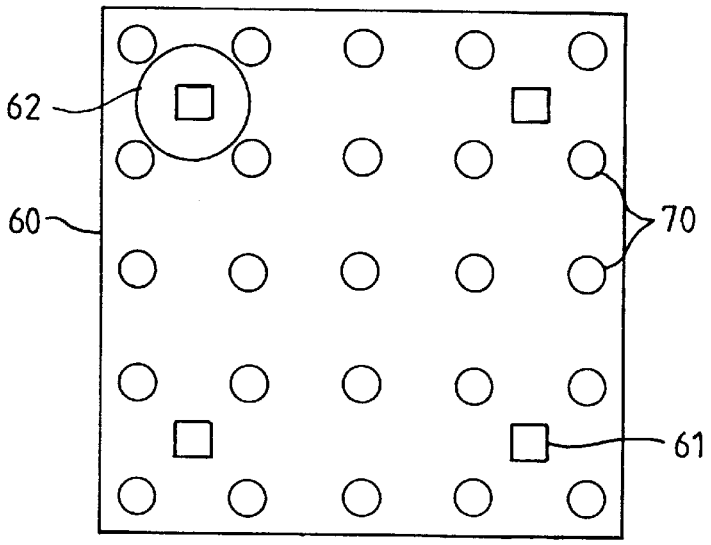
FIG. 8 is a simplified plan view of a magnet of another example of a magnetic matrix display when viewed in the plane 5–5' in FIG. 1 in the direction the arrows.

Referring now to FIG. 8, in a preferred embodiment of the present invention, pixel wells 70 in magnet 60 are each 100 micrometres in diameter on 300 micrometre centres. The control grid is omitted from FIG. 8 in the interests of clarity. Adhesive pads 61 are screen-printed on magnet 60 between at least some of the wells 70. Spacer spheres 62 are then bonded to pads 61. The thickness of back-plate 10 is relatively large (eg: 1 mm) compared with the inter-well spacing. It is desirable to locate spacer spheres 62 at relatively short (1 mm) intervals to minimise local deformation of back-plate 10 between adjacent spacers 62. The diameter of spacer spheres 62 is equal to the distance to be maintained between the control grids on magnet 60 and the cathode 20. External atmospheric pressure forces cathode 20 towards magnet 60. The separation maintained between magnet 60 and cathode 20 is determined by the dimensions of spacers 62.

Glass spheres and rods are employed in conventional liquid crystal displays to maintain precise cell spacings. However, in such displays, the spatial distribution of such spacers is generally random. As will be described shortly, it is desirable in MMD technology to control distribution of spacers 62 between cathode 20 and magnet 60.

Figure 9:
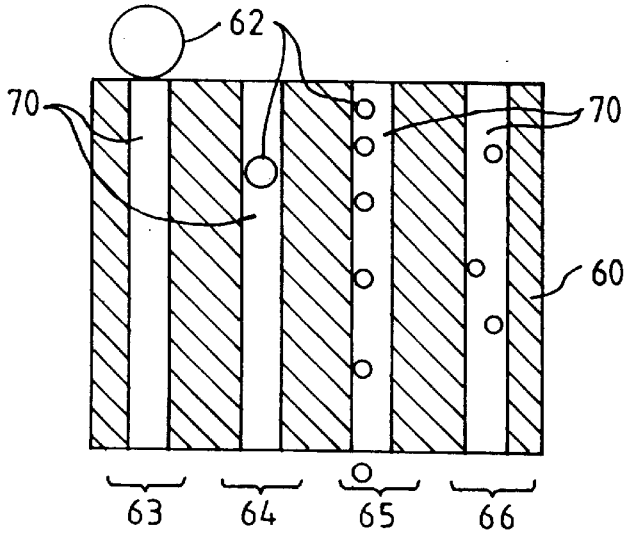
FIG. 9 is a cross section view through a magnet of a magnetic matrix display.

Referring now to FIG. 9, the diameter of pixel wells 70 and the distances between the control grid and cathode 20 may vary between different embodiments of the present invention depending on application. For example, in the arrangement identified in FIG. 9 by the numeral 63, the cathode spacing is larger than the pixel well diameter. Spacer spheres 62 cannot therefore enter pixel wells 70 during manufacture. Excess spheres 62 can be removed easily. In the arrangement identified in FIG. 9 by the numeral 64, the cathode spacing is approximately equal to the pixel well diameter. Spacer spheres 62 may therefore become lodged in pixel wells 70. Such spheres 62 may be difficult to remove. A spacer 62 blocking a pixel well 70 produces a failed pixel on the screen. This arrangement is therefore undesirable. In the arrangements identified in FIG. 9 by the numerals 65 and 66, the cathode spacing is less than the pixel well diameter. Spacers 62 may drop into wells 70. Referring to the arrangement identified in FIG. 9 by the numeral 66, some surplus such spacers 62 may be held in pixel wells 70 by electrostatic attraction. Such spacers 62 may be blown out of wells 70 during manufacture via an air jet.

Figure 10:
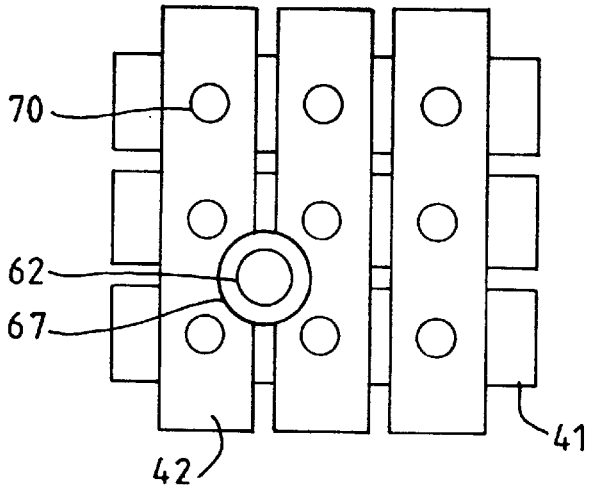
FIG. 10 is a plan view of a control grid of a magnetic matrix display.
Figure 11:
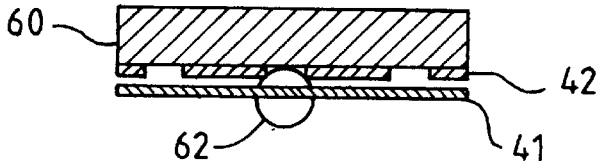
FIG. 11 is a cross sectional view of a magnet and control grid of another magnetic matrix display.

Referring now to FIGS. 10 and 11, in a particularly preferred embodiment of the present invention, an area of the control grid located centrally between four adjacent pixels wells 70 is masked during deposition of the control grid on magnet 60 to provide a clear site 67 for a spacer 62. This arrangement is particularly advantageous because the control grid is not subjected to mechanical stress by the spacer 62 thereby reducing the probability of a short circuit between corresponding row and column grid conductors 41 and 42. Furthermore, the clear site 67 provides a more rigid foundation for the spacer 62. Magnet 60 is relatively hard (eg: a glass-ferrite composite) compared with material employed in the formation of the control grid (eg: aluminium). Therefore, the surface of magnet 60 deforms less than the control grid when a point load is applied via the spacer 62. Still furthermore, the clear site 67 provides a depression in which spacers can be seated. This arrangement permits a reduction in the degree of flatness of magnet 60 because the pressure exerted on the back of cathode 20 effectively forms cathode 20 to the profile of magnet 60. This, in turn, permits production of MMD displays which are not necessarily flat. For example, such displays may be formed as a section of a cylinder or sphere to match non-flat screens.

Figure 12:
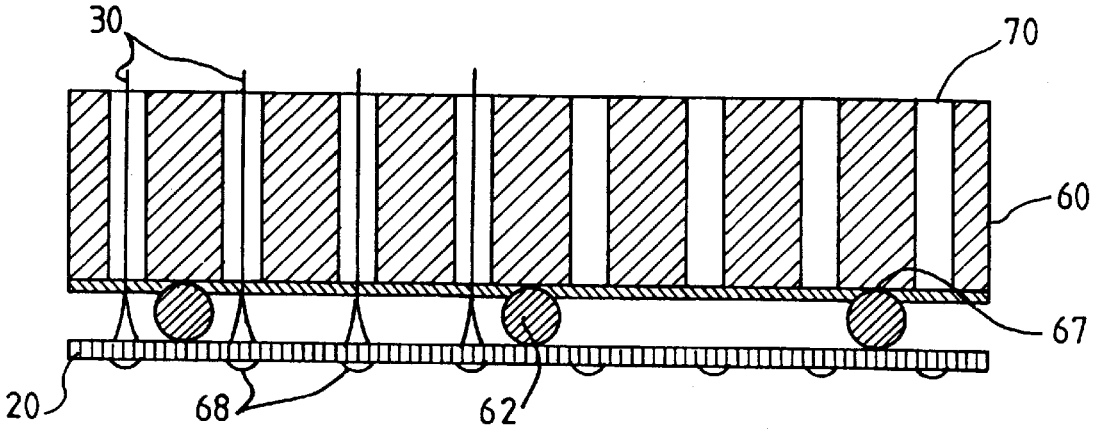
FIG. 12 is a cross section view of yet another magnetic matrix display.

Referring now to FIG. 12, in a particularly preferred embodiment of the present invention, cathode 20 comprises a back-lit photo-cathode and an array of mini-lenses 68 disposed on the side of the photo-cathode remote from magnet 60 for focusing incident light from a light source onto the photo-cathode. Each mini-lens corresponds to a different pixel well 70.

A conventional photo-cathode releases free electrons in response to incident light photons. In use, a photo-cathode is typically contained within an evacuated chamber in which released electrons can move freely under the influence of electric and/or magnetic fields. The efficiency with which a photo-cathode converts incident photons into electron emissions is generally known as the Quantum Efficiency of the photo-cathode. For example, a 100 incident photons produce emission of 20 electrons from the cathode surface, then Quantum efficiency of the photo-cathode is 20%.

The efficiency of a photo-cathode typically varies with wavelength of incident light. Specifically, the efficiency of a photo-cathode typically peaks at a particular wavelength. The wave-length of a photon is indicative of the energy of the photon. Photons having shorter wavelengths such as those in the Ultra-Violet (UV) band have more energy than photons having longer wavelengths such as those in the Infra-Red (IR) band. In general however, photo-cathodes operable in the visible or IR bands are chemically extremely reactive. The surface of such cathodes readily reacts with air thereby diminishing electron emission capability. It is desirable therefore to form such a photo-cathode in an evacuated environment. Reactive cathode surfaces are usually formed by first depositing the constituent elements of the cathode on, for example, a filament. This is then placed in the chamber to be evacuated. After evacuation, the filament is heated to evaporate off the materials previously deposited. The evaporated materials deposit themselves on all surfaces within the chamber, including those not required for cathode operation. This technique is generally employed in the production of devices in which the photo-cathode is contained within a relatively large volume chamber. Examples of such devices include photo-detectors. Pre-forming the cathode surface on a particular part of the chamber prior to assembly is difficult because the reactivity of the cathode surface demands an inert atmosphere up to evacuation of the chamber.

Photo-cathodes operable in the UV region are generally much less reactive than their longer wavelength counterparts. Some UV photo-cathodes are stable in air at least for a short period. Such photo-cathodes are therefore attractive for use in chambers which are preferably assembled after cathode formation. However, these cathodes typically require UV light for stimulation. UV light is significantly attenuated by air and most types of glass. Those glasses which are transparent to UV typically allow Helium to diffuse through them. Such diffusion gradually reduces the internal chamber vacuum. Furthermore, the chamber glass must be sufficiently thick to withstand the mechanical force of atmospheric pressure on the chamber. Absorption of UV light increases with increasing thickness of glass. In photo-cathode technology then, it would be desirable not only to optimising quantum efficiency but also to reduce the problem of Helium diffusion into the vacuum chamber and to reduce the thickness and hence mass of a back-lit photo-cathode structure.

Figure 13:
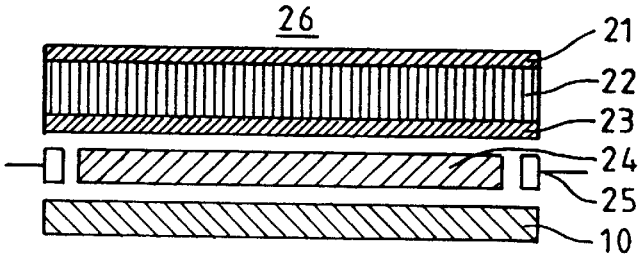
FIG. 13 is a cross section through an example of a back-lit photo-cathode for a magnetic matrix display.

Referring now to FIG. 13, in a particularly preferred embodiment of the present invention a back-lit area photo-cathode comprises an evacuated chamber 26 in which there is disposed a layer of photo-cathode material 21 deposited on the surface of a substrate of silica glass 22 facing into vacuum chamber 26. Examples of suitable photo-cathode materials may be based on one or more lanthanide (Rare Earth) metal. Examples of such metals include Cerium, Terbium, and Samerium. A phosphor layer 23 is deposited on the opposite surface of substrate 22. In operation, the phosphor emits light in the UV region of the spectrum. Examples of such phosphors may be based on Zinc doped Zinc Oxide. The UV light emitted by phosphor 23 passes through silica substrate 22 to cause electron emission into vacuum chamber 26 from cathode layer 21. Phosphor layer 23 is excited by broad spectrum light ranging from UV to IR wavelengths generated by a plasma 24 formed between electrodes 25. Plasma 24 is formed by gases contained between phosphor layer 23, electrodes 25 and back plate 10. The gases are at a reduced pressure relative to atmospheric but greater than that within chamber 26. Back-plate 10 is formed from a material which is sufficiently strong to support atmospheric pressure and which is impermeable to Helium. In a particularly preferred embodiment of the present invention, back-plate 10 is formed from a Helium-impermeable glass. It will be appreciated that back-plate 10, plasma 24, electrodes 25, and phosphor 23 in combination act as a plane fluorescent lamp. As mentioned earlier, the plasma emits light over a broad range of wavelengths. Phosphor layer 23 acts as a "wavelength transformer" with a photon emission frequency selected to maximise the quantum efficiency of photo-cathode layer 21. Because back-plate 10 supports most of the load imposed by atmospheric pressure, silica layer 22 can be made thinner, thereby reducing weight, cost, and UV absorption.

Figure 14:
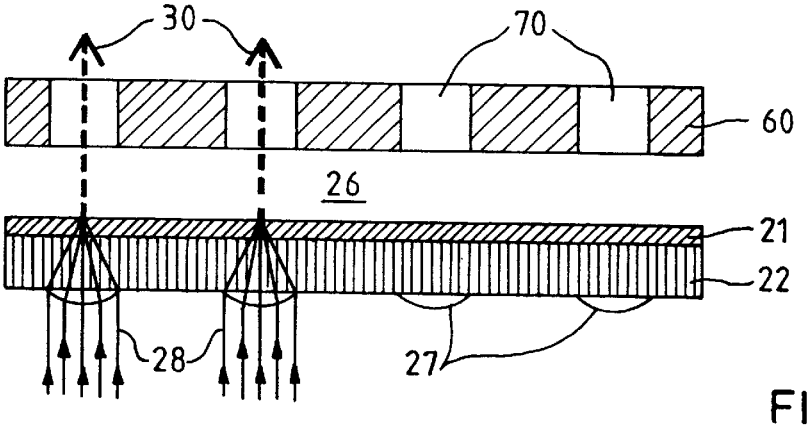
FIG. 14 is a cross section through an example of a magnetic matrix display comprising a back-lit photo-cathode; and, FIG. 15 is a cross section through another example of a back-lit photo-cathode for a magnetic matrix display.

Referring now to FIG. 14, in an especially preferred embodiment of the present invention, a back-lit photo-cathode assembly of the kind hereinbefore described with reference to FIG. 13 is integrated in a magnetic matrix display. An array of convex mini-lenses 27 is disposed between the phosphor layer (not shown in FIG. 14) and silica glass layer 22. Each lens 27 corresponds to a different pixel well 70. In operation, each lens 27 focuses UV light 28 emitted from the phosphor layer onto a point or region of photo-cathode 21 facing the corresponding pixel well 70. This increases electron emission from the region of photo-cathode 21 immediately below the corresponding pixel well 70 (Note that the electron collection area of the MMD is relatively small because of the aforementioned collimating effect of the magnetic field from magnet 60).

Figure 15:
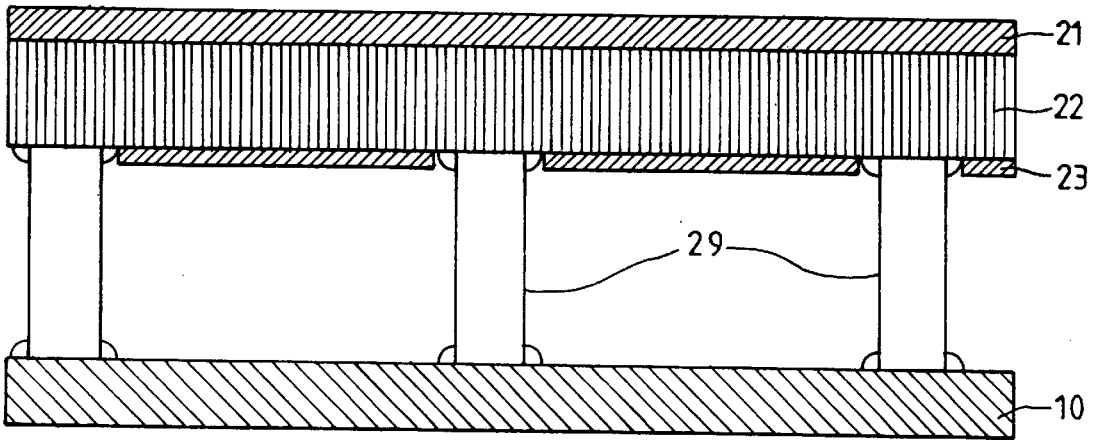

Referring now to FIG. 15, in a particularly preferred embodiment of the present invention, spacers 29 are disposed between silica layer 22 and back-plate 10 and secured to both via adhesive bonds. Spacers 29 increase the mechanical strength of the structure thereby permitting a further reduction in the thickness of silica layer 22 needed to withstand the differential pressure between plasma 24 and chamber 26. The further reduction in thickness of silica layer 22 provides a further reduction in weight, cost, and UV absorption. In some embodiments of the present invention, spacers 29 may permit layer 22 to be implemented in other less expensive glasses which are transparent only in the near UV waveband but which are sufficiently thin that the associated UV absorption is within an acceptable level.

Preferred embodiments of a back-lit photo-cathode arrangement have been hereinbefore described with reference to a magnetic matrix display. It will however be appreciated that such an arrangement is not limited in application to magnet matrix displays and may, in addition, find application in other vacuum electron devices.

By way of the summary of the preferred embodiments of the present invention hereinbefore described, a display device comprises a screen. A back plate is sealed to the screen to form an evacuated chamber. Area cathode means is disposed between the back plate and the screen. A permanent magnet is disposed between the cathode and the screen. A two dimensional array of rows and columns of channels extends between opposite poles of the magnet for receiving electrons from the cathode means. An anode phosphor layer is disposed between screen and the magnet for receiving electrons from the channels. Grid electrode means between the area cathode means and the magnet controls flow of electrons from the cathode means into the channels. Anode means between the magnet and the anode phosphor layer for controls flow of electrons from the channels towards the screen. In one such arrangement, the screen comprises a layer of a plastic material. In another such arrangement a plurality of spacers are disposed between the screen and the magnet. Each spacer has an elongate body having a larger cross sectional area at one end of the spacer tapering to a smaller cross sectional area at the other end of the spacer. In another such arrangement, a plurality of spacers are disposed between the magnet and cathode. The spacers are located in recesses formed in the grid electrode means. In yet another such arrangement, the cathode means comprises a back-plate and a silica glass substrate peripherally sealed to the back-plate to produce a chamber. A gas is contained in the chamber. A layer of photo-sensitive material is disposed on the surface of the substrate external to the chamber. A cathode phosphor layer is disposed between the back plate and the substrate. A pair of electrodes facing each other from opposite sides of the chamber energises the gas to generate a plasma for exciting the cathode phosphor to generate light energy to produce electron emissions from the photo-cathode.

We claim:

1. A display device comprising: a screen comprising a layer of a transparent plastic material; a back plate sealed to the screen to form an evacuated chamber; area cathode means disposed between the back plate and the screen; a permanent magnet disposed between the cathode and the screen; a two dimensional array of rows and columns of channels extending between opposite poles of the magnet for receiving electrons from the cathode; an anode phosphor layer disposed between screen and the magnet for receiving electrons from the channels; grid electrode means disposed between the area cathode means and the magnet for controlling flow of electrons from the cathode means into the channels; and anode means disposed between the magnet and the anode phosphor layer for controlling flow of electrons from the channels towards the screen.

2. A display device as claimed in claim 1, wherein the screen comprises a barrier layer disposed between plastic layer and the anode phosphor layer for preventing outgassing from the plastic layer into the evacuated chamber.

3. A display device as claimed in claim 2, wherein the barrier layer comprises a glass layer.

4. A display device as claimed in claim 2, wherein the barrier layer comprises a hardened polymer coating.

5. A display device as claimed in claim 4, wherein the screen comprises a pre-curved portion brought into a compressed state by pressure difference between the evacuated chamber and atmospheric pressure.

6. A display device comprising a screen; a back plate sealed to the screen to form an evacuated chamber; area cathode means disposed between the back plate and the screen; a permanent magnet disposed between the cathode and the screen; a two dimensional array of rows and columns of channels extending between opposite poles of the magnet for receiving electrons from the cathode; an anode phosphor layer disposed between the screen and the magnet for receiving electrons from the channels; grid electrode means disposed between the area cathode means and the magnet for controlling flow of electrons from the cathode means into the channels; anode means disposed between the magnet and the anode phosphor layer for controlling flow of electrons from the channels towards the screen; and a plurality of spacers disposed between the screen and the magnet for spacing the screen from the magnet, each spacer comprising an elongate body having a larger cross sectional area at one end of the spacer tapering to a smaller cross sectional area at the other end of the spacer.

7. A display device comprising: a screen; a back plate sealed to the screen to form an evacuated chamber; area cathode means disposed between the back plate and the screen; a permanent magnet disposed between the cathode and the screen; a two dimensional array of rows and columns of channels extending between opposite poles of the magnet for receiving electrons from the cathode; a phosphor layer disposed between.screen and the magnet for receiving electrons from the channels; grid electrode means disposed between the area cathode means and the magnet for controlling flow of electrons from the cathode means into the channels; anode means disposed between the magnet and the anode phosphor layer for controlling flow of electrons from the channels towards the screen; and a plurality of spacers for spacing the magnet from the cathode, the spacers being disposed within recesses formed in the grid electrode means.

8. A display device comprising: a screen; area cathode apparatus sealed to the screen to form an evacuated chamber, wherein the area cathode apparatus comprises a back plate, silica glass substrate peripherally sealed to the back plate to produce the chamber, a gas contained in the chamber, a layer of photo-sensitive material disposed on the surface of the substrate external to the chamber, a cathode phosphor layer disposed between the back plate and the substrate, and a pair of electrode facing each other from opposite sides of the chamber for energizing the gas to generate a plasma for exciting the cathode phosphor layer to generate light energy for producing electron emissions from the photo-sensitive material; a permanent magnet disposed between the area cathode apparatus and the screen; a two dimensional array of rows and columns of channels extending between opposite poles of the magnet for receiving electrons from the area cathode apparatus; an anode phosphor layer disposed between the screen and the magnet for receiving electrons from the channels; grid electrode means disposed between the area cathode apparatus and the magnet for controlling flow of electrons from the area cathode apparatus into the channels; and anode means disposed between the magnet and the anode phosphor layer for controlling flow of electrons from the channels towards the screen.

9. A display device as claimed in claim 8, wherein the area cathode apparatus further comprises an array of convex lenses disposed between the cathode phosphor layer and substrate, each lens corresponding to a different channel and each lens focusing light energy from the cathode phosphor layer onto a different region of the area cathode apparatus.

* * * * *